US011563274B2

(12) United States Patent
Samardzija et al.

(10) Patent No.: US 11,563,274 B2
(45) Date of Patent: Jan. 24, 2023

(54) PCB FED ANTENNAS INTEGRATED WITH METALLIC BODY

(71) Applicant: Plume Design, Inc., Palo Alto, CA (US)

(72) Inventors: Miroslav Samardzija, Mountain View, CA (US); Arthur Tung, San Jose, CA (US); Brian Nam, San Jose, CA (US); Liem Hieu Dinh Vo, San Jose, CA (US)

(73) Assignee: Plume Design, Inc., Palo Alto, CA (US)

( * ) Notice: Subject to any disclaimer, the term of this patent is extended or adjusted under 35 U.S.C. 154(b) by 265 days.

(21) Appl. No.: 17/083,802

(22) Filed: Oct. 29, 2020

(65) Prior Publication Data

US 2022/0140484 A1 May 5, 2022

(51) Int. Cl.

| | |
|---|---|
| ***H01Q 1/22*** | (2006.01) |
| ***H01Q 9/16*** | (2006.01) |
| ***H01Q 1/38*** | (2006.01) |
| ***H01Q 1/02*** | (2006.01) |

(52) U.S. Cl.
CPC ..... *H01Q 9/16* (2013.01); *H01Q 1/02* (2013.01); *H01Q 1/38* (2013.01)

(58) Field of Classification Search
CPC .. H01Q 9/16; H01Q 1/02; H01Q 1/38; H01Q 1/243; H01Q 1/44; H01Q 1/24
See application file for complete search history.

(56) References Cited

U.S. PATENT DOCUMENTS

| | | | |
|---|---|---|---|
| 6,853,197 | B1 | 2/2005 | McFarland et al. |
| 6,961,545 | B2 | 11/2005 | Tehrani et al. |
| 7,245,882 | B1 | 7/2007 | McFarland |
| 7,245,893 | B1 | 7/2007 | Husted et al. |
| 7,251,459 | B2 | 7/2007 | McFarland et al. |
| 9,136,937 | B1 | 9/2015 | Cheng et al. |
| 9,160,584 | B1 | 10/2015 | Kavousian et al. |
| 2013/0090057 | A1 | 4/2013 | Green et al. |
| 2013/0293424 | A1 | 11/2013 | Zhu et al. |
| 2014/0009344 | A1 | 1/2014 | Zhu et al. |
| 2014/0009355 | A1 | 1/2014 | Samardzija et al. |
| 2014/0112511 | A1 | 4/2014 | Corbin et al. |
| 2014/0226572 | A1 | 8/2014 | Thota et al. |
| 2014/0340265 | A1 | 11/2014 | Vazquez et al. |
| 2015/0099474 | A1 | 4/2015 | Varga et al. |
| 2015/0109167 | A1 | 4/2015 | Varga et al. |
| 2015/0195836 | A1 | 7/2015 | Malkin et al. |
| 2015/0302976 | A1 | 10/2015 | Chang et al. |

(Continued)

*Primary Examiner* — David E Lotter
(74) *Attorney, Agent, or Firm* — Lawrence A. Baratta, Jr.

(57) ABSTRACT

An integrated metallic component includes a metallic body and an antenna. The metallic body is adapted to at least one of act as a heat exchanger and at least partially enclose electronic components on a Printed Circuit Board (PCB. The antenna includes an antenna element, a short wall, and an antenna feed leg. The antenna element is offset from the metallic body and includes a length extending along a perimeter of the metallic body. The short wall connects the antenna element to the metallic body. The antenna feed leg is offset from the short wall in a direction of the length of the antenna element and adapted to extend from the antenna element to the PCB and to form an electrical connection with an electrical contact for a Radio Frequency (RF) signal trace on the PCB.

21 Claims, 9 Drawing Sheets

(56) References Cited

U.S. PATENT DOCUMENTS

| | | | | |
|---|---|---|---|---|
| 2015/0303568 | A1 | 10/2015 | Varga et al. | |
| 2015/0311960 | A1 | 10/2015 | Samardzija et al. | |
| 2016/0056526 | A1 | 2/2016 | Li et al. | |
| 2016/0254588 | A1* | 9/2016 | Kim | H01Q 1/243 343/702 |
| 2016/0336643 | A1 | 11/2016 | Pascolini et al. | |
| 2017/0062906 | A1* | 3/2017 | McAuliffe | H01Q 1/06 |
| 2017/0309986 | A1* | 10/2017 | Wang | H01Q 5/378 |

* cited by examiner

PCB FED ANTENNAS INTEGRATED WITH METALLIC BODY

FIELD OF THE DISCLOSURE

The present disclosure generally relates to antennas. More particularly, the present disclosure relates to systems and methods for antennas integrated with a metallic body.

BACKGROUND OF THE DISCLOSURE

Various devices utilize antennas for wireless communication, such as wireless Access Points (APs), streaming media devices, laptops, tablets, and the like (collectively "wireless devices"). Further, the design trend for such devices is focused on aesthetics, compact form factors, etc., causing difficulty in antenna design. These wireless devices require communication utilizing Wi-Fi, Bluetooth, Zigbee, Zwave, and the like, which can require multiple antennas for their implementation. Typical wireless devices generally include three hardware sections for transmitting and receiving wireless signals. These three hardware sections are illustrated in FIG. 1, which is a schematic illustration of a typical transmitting and receiving configuration 10 of a wireless device. The three hardware section of the typical transmitting and receiving configuration 10 include a radio 13, a bridge 12, and an antenna 11.

The radio 13 is typically located on a Printed Circuit Board (PCB) or a flex and is accompanied by other components, such as Front End Modules (FEMs), filters, switches, a Local Oscillator (LO), mixers, fans, coolers, heatsinks, and the like. The bridge 12 connects the radio to the antenna and is typically formed of coaxial cable, flex, spring clips, contact pads, and the like. The antenna 11 is typically formed of stamped and/or shaped sheet metal, flex with electrically conductive layer, plastic with printed electrically conductive layer, open or closed slots and cuts in metal, and the like.

The physical connections between each antenna 11, the corresponding bridge 12, and the corresponding radio 13 are typically made one at a time in a wireless device. Individually forming the connections for each antenna 11 and corresponding bridge 12 of a wireless device can require a significant amount of time, and thus can increase manufacturing time and costs for the wireless device.

BRIEF SUMMARY OF THE DISCLOSURE

In an embodiment, an integrated metallic component is disclosed. The integrated metallic component includes a metallic body and an antenna. The metallic body is adapted to at least one of act as a heat exchanger and at least partially enclose electronic components on a Printed Circuit Board (PCB). The antenna includes an antenna element, a short wall, and an antenna feed leg. The antenna element is offset from the metallic body and includes a length extending along a perimeter of the metallic body. The short wall connects the antenna element to the metallic body. The antenna feed leg is offset from the short wall in a direction of the length of the antenna element and adapted to extend from the antenna element to the PCB and to form an electrical connection with an electrical contact for a Radio Frequency (RF) signal trace on the PCB.

In embodiments, the metallic body forms a continuous shield around circuitry in a device including the integrated metallic component.

In embodiments, the metallic body is adapted to both act as a heat sink.

In embodiments, the integrated metallic component includes a plurality of the antenna positioned about the perimeter of the metallic body, each connected thereto by a corresponding short wall. Optionally, each of the plurality of antennas is adapted to operate at a different frequency. Optionally, the plurality of antennas is operating at a same frequency in a Multiple Input Multiple Output (MIMO) configuration. Optionally, adjacent antennas of the plurality of antennas are separated by less than a quarter wavelength of operating frequencies thereof.

In embodiments, the antenna feed leg forms a cavity in a feed contact end therein, and wherein the cavity is adapted to receive the electrical contact therein with a surface forming the cavity contacting the electrical contact to form the electrical connection while the feed contact end is in contact with the PCB.

In embodiments, the integrated metallic component is a unitary structure with the metallic body, the antenna element, the short wall, and the antenna feed leg being a single structurally formed unibody. The unitary structure is unitarily formed by one of molding, stamping and folding, and Computer Numerical Control (CNC) machining a single piece of material into the integrated metallic component.

In embodiments, a length of the antenna element is from 10 to 20 percent of a wavelength that the antenna is adapted to receive, a width of the antenna element is from 20 to 30 percent of the length of the antenna element, and a thickness of the antenna element is from 70 to 80 percent of the length of the antenna element.

In embodiments, the antenna further includes at least one antenna termination leg offset from the antenna feed leg in a direction of the length of the antenna element and adapted to extend from the antenna element to the PCB and to form an electrical connection with an electrical contact for an RF signal return on the PCB.

In another embodiment, an integrated antenna system is disclosed. The integrated antenna system includes a PCB and an integrated metallic component. The PCB includes an RF signal trace and electronic components. The integrated metallic component includes a metallic body and an antenna. The metallic body at least partially enclosing the electronic components. The antenna includes an antenna element, a short wall, and an antenna feed leg. The antenna element is offset from the metallic body and including a length extending along a perimeter of the metallic body. The short wall connects the antenna element to the metallic body. The antenna feed leg is offset from the short wall in a direction of the length of the antenna element and extends from the antenna element to the PCB. The antenna feed leg forms an electrical connection with an electrical contact for the RF signal trace.

In embodiments, the antenna feed leg forms a cavity in a feed contact end therein, and wherein the electrical contact is received in the cavity with a surface forming the cavity contacting the electrical contact to form the electrical connection with the PCB.

In embodiments, the integrated metallic component is a unitary structure with the metallic body, the antenna element, the short wall, and the antenna feed leg being a single structurally formed unibody. The unitary structure is unitarily formed by one of molding, stamping and folding, and Computer Numerical Control (CNC) machining a single piece of material into the integrated metallic component.

In embodiments, a length of the antenna element is from 10 to 20 percent of a wavelength that the antenna is adapted to receive, a width of the antenna element is from 20 to 30 percent of the length of the antenna element, and a thickness of the antenna element is from 70 to 80 percent of the length of the antenna element.

In embodiments, the antenna further includes at least one antenna termination leg offset from the antenna feed leg in a direction of the length of the antenna element, the at least one antenna termination leg extending from the antenna element to the PCB and forms an electrical connection with an electrical contact for an RF signal return on the PCB.

In embodiments, the integrated metallic component includes a plurality of the antenna, the plurality of the antenna positioned around a perimeter of the metallic body, and wherein the metallic body and the plurality of the antenna are a unitary structure that is unitarily formed.

In a further embodiment, a wireless device is enclosed. The wireless device includes a PCB and at least one integrated metallic component. The PCB includes at least on RF signal trace and electronic components. The at least one integrated metallic component includes a metallic body and at least one antenna. The metallic body is at least partially enclosing the electronic components. The at least one antenna includes an antenna element, a short wall, and an antenna feed leg. The antenna element is offset from the metallic body and includes a length extending along a perimeter of the metallic body. The short wall connects the antenna element to the metallic body. The antenna feed leg is offset from the short wall in a direction of the length of the antenna element and extending from the antenna element to the PCB. The antenna feed leg forms an electrical connection with an electrical contact for the RF signal trace.

In embodiments, the antenna feed leg forms a cavity in a feed contact end therein, and wherein the electrical contact is received in the cavity with a surface forming the cavity contacting the electrical contact to form the electrical connection with the PCB.

In embodiments, each of the at least one integrated metallic component is a unitary structure with the metallic body, the antenna element, the short wall, and the antenna feed leg being a single structurally formed unibody. The unitary structure is unitarily formed by one of molding, stamping and folding, and Computer Numerical Control (CNC) machining a single piece of material into the integrated metallic component.

In embodiments, a length of the antenna element, for each of the at least one antenna, is from 10 to 20 percent of a wavelength that the antenna element is adapted to receive, a width of the antenna element is from 20 to 30 percent of the length of the antenna element, and a thickness of the antenna element is from 70 to 80 percent of the length of the antenna element.

In embodiments, the at least one antenna further includes at least one antenna termination leg offset from the antenna feed leg in a direction of the length of the antenna element, the at least one antenna termination leg extending from the antenna element to the PCB and forms an electrical connection with an electrical contact for an RF signal return on the PCB.

In embodiments, each of the at least one metallic components comprises a heat sink.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various embodiments, the present disclosure relates to systems and methods for integrated antenna systems. The integrated antenna systems include a PCB and an integrated metallic component. The integrated metallic component includes a metallic body that at least one of shields electronic components on the PCB and is adapted to act as a heat exchanger. The integrated metallic component also includes an antenna. The antenna element of the antenna is offset from a perimeter of the metallic enclosure, extends along the perimeter, and is integrally connected to the metallic enclosure by a short wall.

By integrating the antenna with the metallic body, such as by unitarily forming the metallic body and the antenna by one of molding, stamping and folding, and Computer Numerical Control (CNC) machining a single piece of material, the entirety of the integrated metallic component can be installed in a single step, which includes connecting the antenna element signal traces on the PCB, such as by aligning feed legs of the antenna with contact elements of the signal traces.

Further, the metallic body can both shield the electronic components and act as a heat exchanger, such as a heat sink integrated in a shield. As such, the integrated metallic component is a shield for the electronic components, a heat sink, and an antenna, blurring the lines between an RF PCB, heat sinks, and antennas.

Figure 1:
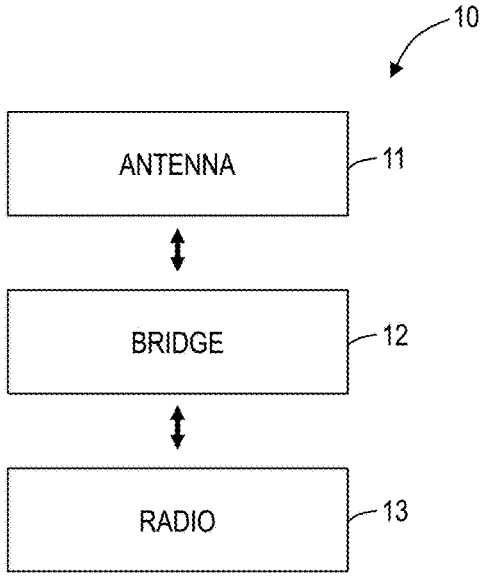
FIG. 1 is a schematic illustration of a typical transmitting and receiving configuration of a wireless device.
Figure 2:
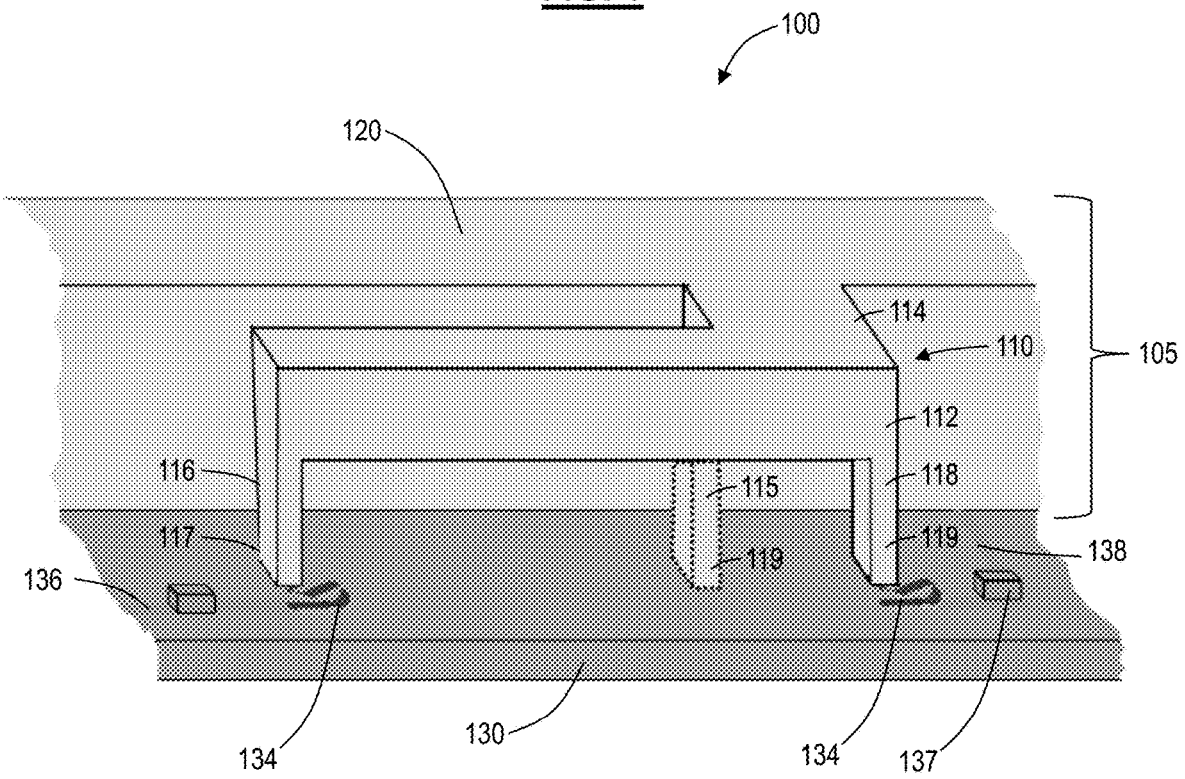
FIG. 2 is a perspective diagram of an integrated antenna system.
Figure 3:
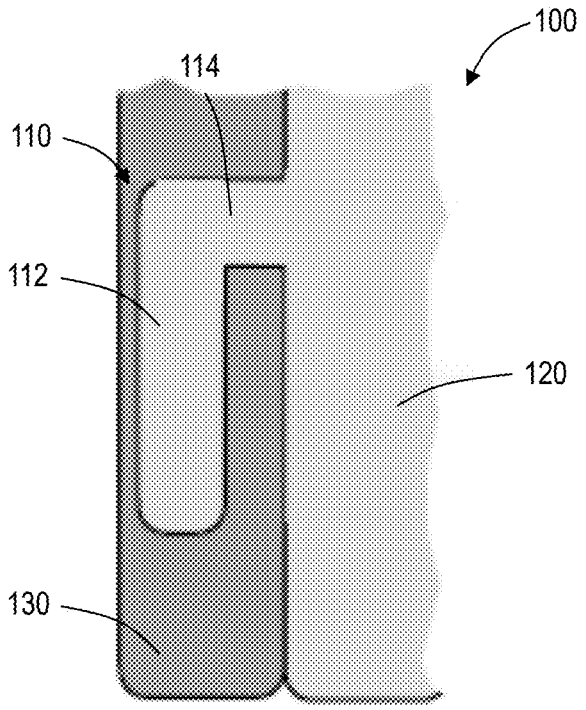
FIG. 3 is a top perspective diagram of the integrated antenna system of FIG. 2.
Figure 4:
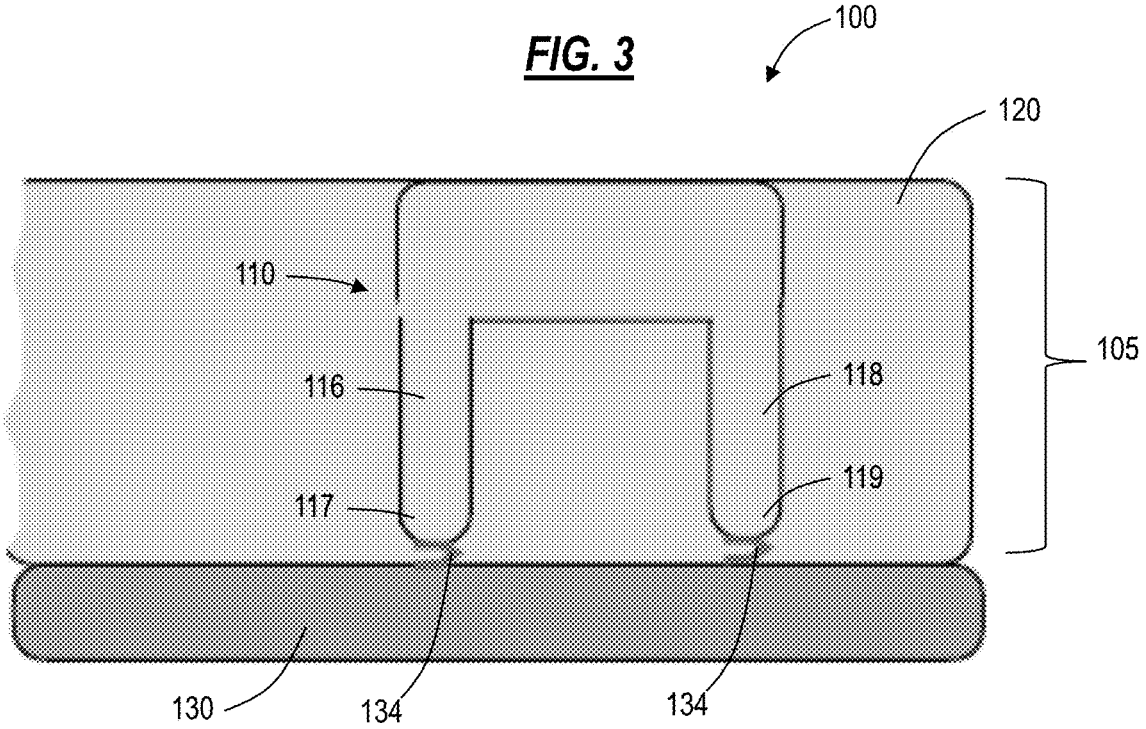
FIG. 4 is a side perspective diagram of the integrated antenna system of FIGS. 2 and 3.

FIG. 2 is a perspective diagram of an integrated antenna system 100. FIG. 3 is a top perspective diagram of the integrated antenna system 100 of FIG. 2. FIG. 4 is a side perspective diagram of the integrated antenna system 100 of FIGS. 2 and 3. The integrated antenna system 100 includes an integrated metallic component 105 and a PCB 130. The integrated metallic component 105 includes a metallic body 120 and one or more antennas 110.

The metallic body 120 is adapted to at least one of enclose electronic components of an electronic device therein act as a heat exchanger, such as a heat sink or a cold plate. In some embodiments, the metallic body 120 forms a continuous shield around circuitry of a respective device, such as the electronic components mounted on the PCB 130. In embodiments, the metallic body 120 is also connected to a Radio Frequency (RF) ground of the PCB 130. In some embodiments, the metallic body 120 is adapted to both shield the electronic components and act as a heat exchanger.

Each of the one or more antennas 110 includes an antenna element 112, a short wall 114, and an antenna feed leg 116. The antenna element 112 is positioned and oriented adjacent to and offset from a perimeter edge of the metallic body 120. In the embodiment illustrated, the antenna element 112 extends along the perimeter edge of the metallic body 120, such as lengthwise, parallel, or tangential to the perimeter edge of the metallic body 120. In embodiments, the antenna element 112 generally matches a contour of the perimeter edge of the metallic body 120 along the length of the antenna element 112.

The antenna element 112 can be adapted for use with various technologies and standards, such as short-range radio (such as Bluetooth), Zigbee, Ultra-Wide Band (UWB), Cellular, Dual band Wi-Fi, and the like.

The gap between the perimeter edge of the metallic body 120 and the antenna element 112 is selected to minimize a profile of the antenna 110. In embodiments, the gap is approximately a quarter of the length of the antenna element 112. In embodiments, the gap is from 20 percent to 30 percent of the length of the antenna element 112.

In embodiments, the length of the antenna element 112 is less than a quarter of the wavelength that the antenna 110 is adapted to receive. In some embodiments, the antenna element 112 is approximately one-sixth of the wavelength, such as from ten percent to twenty percent of the wavelength. For example, a wavelength for a 5 GHz signal is approximately 60 millimeters and the length of the antenna element 112 is from 6 millimeters to 12 millimeters, such as 10 millimeters.

In embodiments, a width of the antenna element 112 is similar to that of the gap and is approximately a quarter of the length of the antenna element 112, such as from 20 percent to 30 percent of the length of the antenna element 112. In the 5 GHz example above, where the length of the antenna element is 10 millimeters, the width of the antenna element 112 is from 2 millimeters to 3 millimeters, such as 2.5 millimeters.

In embodiments, a thickness of the antenna element 112 is approximately three-quarters of the length of the antenna element 112, such as from 70 percent to 80 percent of the length of the antenna element 112. In the 5 GHz example above, where the length of the antenna element is 10 millimeters, the thickness of the antenna element 112 is from 7 millimeters to 8 millimeters, such as 7.5 millimeters. In some embodiments, the width and the thickness dimensions are interchanged.

The short wall 114 connects the antenna element 112 to the metallic body 120. In embodiments, the width of the short wall 114 from the metallic body 120 to the antenna element 112 is that of the gap, such as approximately a quarter of the length of the antenna element 112. In embodiments, the width of the short wall 114 is from 20 percent to 30 percent of the length of the antenna element 112. In the embodiment illustrated, the short wall 114 is positioned at an end of the antenna element 112. In other embodiments, the short wall 114 is positioned between the ends of the antenna element 112 along a length of the antenna element 112.

In some embodiments, a length of the antenna element 112 is less than one-fifth of a wavelength that the antenna 110 is adapted to receive, a width of the antenna element 112 is less than one-twentieth of the wavelength, and a thickness of the antenna element 112 is less than one-fifth of the wavelength, wherein a sum of the length, the width and the thickness is less than one-half of the wavelength. In embodiments, a surface area of the antenna element is more than one-fifth by one-fifth squared wavelengths.

The antenna feed leg 116 is offset from the short wall 114 along the length of the antenna element 112. In the embodiment illustrated, the antenna feed leg 116 is positioned distal to the short wall 114 with regards to the antenna element 112, such as at or adjacent to an end of the antenna element 112. The antenna feed leg 116 extends from the antenna element 112 to the PCB 130 and includes a feed contact end 117 that is adapted to receive an electrical current from the PCB 130.

In embodiments, such as the embodiment illustrated in FIGS. 2-4, the antenna 110 also includes one or more antenna termination legs 115, 118. Each of the one or more antenna termination legs 115, 118 are offset from the antenna feed leg 116 along the length of the antenna element 112. In the embodiment illustrated, the antenna termination leg 118 is proximal to the short wall 114 and distal to the antenna feed leg 116 and the antenna termination leg 118 is positioned between the short wall 114 and the antenna feed leg 116. Other configurations of antenna termination legs 115, 118 are also contemplated. Each of the one or more antenna termination legs 115, 118 extends from the antenna element 112 to the PCB 130 and includes a termination contact end 119 that is adapted to provide the electrical current to the PCB 130. In embodiments, the antenna feed leg 116 and the one or more antenna termination legs 115, 118 provide support for the antenna element 110, provide support for the integrated metallic component 105, and tune the antenna element 110.

While two additional antenna termination legs 115, 118 are shown in the illustrated embodiment, additional antenna termination legs 115 can also be included. In embodiments, the number of antenna termination legs 115, 118 and the positioning thereof, along with the antenna feed leg 116 and the position thereof, is based on one or more of physical support requirements for the integrated metallic component 105 and tuning requirements for the antenna element 110.

Referring to FIG. 2, the PCB 130 includes a Radio Frequency (RF) signal trace 136 that is adapted to provide an electric current to the antenna element 110 via the antenna feed leg 116. In the embodiment illustrated, the electrical connection between the RF signal trace 136 and the feed contact end 117 is facilitated by an electrical contact 134. In the embodiment illustrated, the electrical contact 134 is a spring clip. However, other contact mechanisms, such as contact pads, rubber gaskets, solders, and the like, are also contemplated.

In embodiments including one or more antenna termination legs 115, 118, the PCB 130 also includes an RF signal return 138. In embodiments, the RF signal return 138 includes a matching network 137. The matching network 137 can include inductors (L) and/or capacitors (C), or may be left open. In the embodiment illustrated, the electrical connection between the RF signal return 138 and the termination contact end 119 is facilitated by an electrical contact 134.

Figure 5:
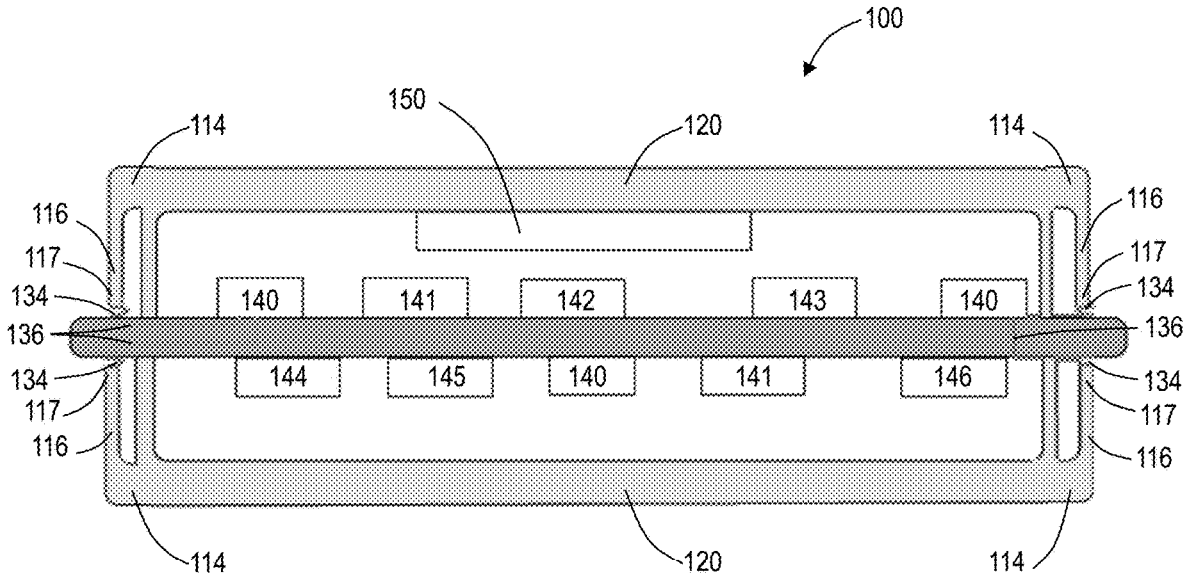
FIG. 5 is a cross-sectional diagram of an embodiment of the integrated antenna system of FIG. 2 including two integrated metallic components.

FIG. 5 is a cross-sectional diagram of an embodiment of the integrated antenna system 100 of FIG. 2 including two integrated metallic components 105. Referring to FIG. 5, the RF signal trace 136 and the RF signal return 138 can be at a surface of the PCB 130, such as on the top or bottom layer of the PCB 130, or can be embedded in the PCB 130, such as on a middle layer of the PCB 130.

The integrated antenna system 100 also includes electronic components on the PCB 130. In embodiments, these electronic components include one or more FEMs 140, one or more radios 141, memory 142, AC/DC 143, electronics 144, switches 145, storage 146, and the like. The RF signal traces 146 and the RF signal returns 138 electrically connect the antenna feed legs 116 and the antenna termination legs 115, 118 to a corresponding radio 140.

In the embodiment illustrated in FIG. 5, the integrated antenna system 100 includes multiple integrated metallic components 105, each including multiple antennas 110. In the embodiment illustrated, each of the integrated metallic components 105 is a unitary structure where the metallic body 120 and the antennas 110 are a single structurally formed unibody. In some of these embodiments, each of the integrated metallic components 105 is unitarily formed by molding, Computer Numerical Control (CNC) machining, or stamping and folding a single piece of material into the integrated metallic component 105. Such unitary formation of the integrated metallic components 105 avoid issues, such as structural weaknesses in metallurgical bonds used to join metallic components together in non-unitarily formed structures.

In some embodiments, the multiple antennas 110 operate at a same frequency and are configured to operate in a Multiple Input Multiple Output (MIMO) configuration. In other embodiments, the multiple antennas 110 operate at different frequencies. The multiple antennas 110 are disposed around a perimeter of the metallic body 120. In some embodiments, adjacent antennas are separated by less than a quarter wavelength of operating frequencies thereof.

As can be seen in FIG. 5, each of the metallic bodies 120 surrounds and encloses electronic components on the PCB 130 within the metallic body 120 and between the metallic body 120 and the PCB 130. As noted above, in embodiments, the metallic body 120 is also a heat exchanger, such as a heatsink or a cold plate. In embodiments, the integrated antenna system 100 includes one or more fans 150 that circulates air within the metallic body 120 and facilitates heat transfer to the metallic body 120.

Figure 6:
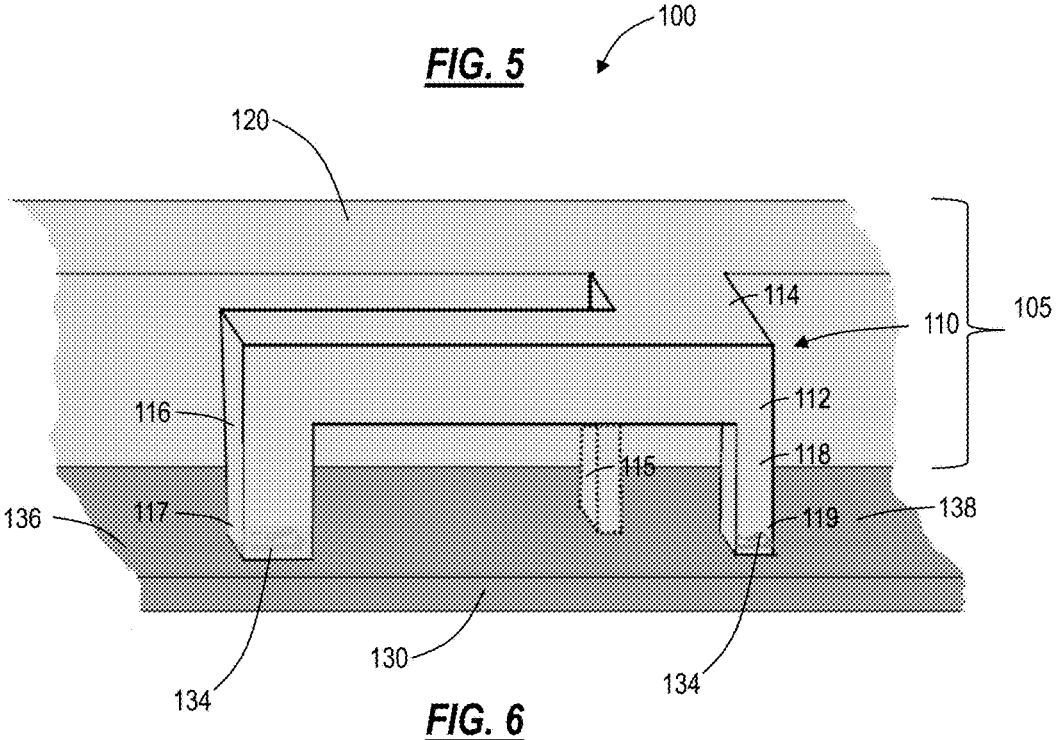
FIG. 6 is a perspective diagram of an embodiment of the integrated antenna system of FIG. 2.
Figure 7:
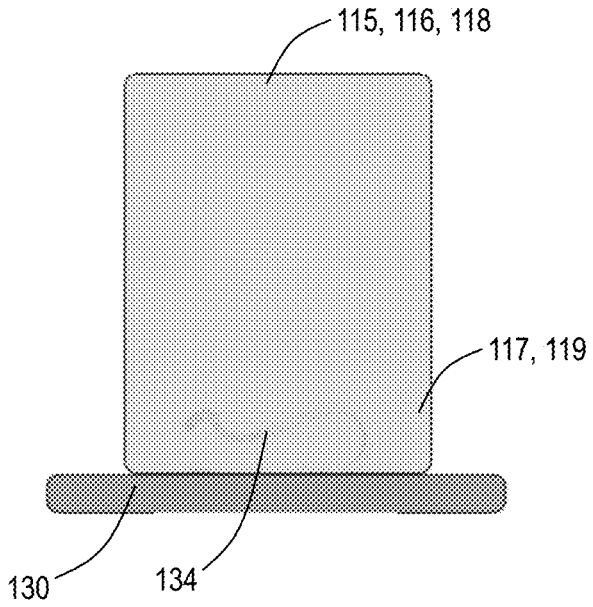
FIG. 7 is a side perspective diagram of an antenna leg for the integrated antenna system of FIG. 6.
Figure 8:
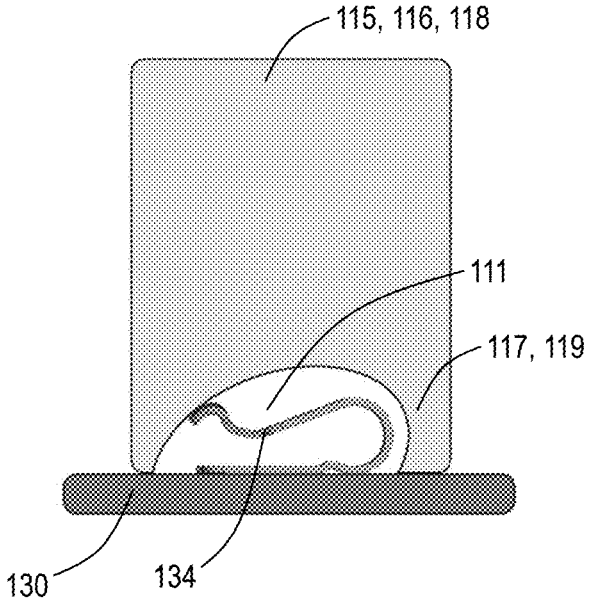
FIG. 8 is a cross-sectional diagram of the antenna leg of FIG. 7.

FIG. 6 is a perspective diagram of an embodiment of the integrated antenna system 100 of FIG. 2. FIG. 7 is a side perspective diagram of an antenna leg 115, 116, 118 for the integrated antenna system of FIG. 6. FIG. 8 is a cross-sectional diagram of the antenna leg 115, 116, 118 of FIG. 7. Referring to FIGS. 6-8, in embodiments, one or more antenna legs 115, 116, 118, such as the antenna feed leg 116 and the antenna termination legs 115, 118, form a cavity 111 in the contact end 117, 119, such as the feed contact end 117 and the termination contact end 119. The cavity 111 is adapted to hide the trace contact point, such as the electrical contact 134 therein while facilitating the electrical connection between the antenna leg 115, 116, 118 and the respective RF trace 136, 138. In embodiments, a surface 113 of the cavity is adapted to contact the electrical contact 134 and establish the electrical connection between the antenna leg 115, 116, 118 and the respective RF trace 136 at least while the antenna leg 115, 116, 118 is in contact with the PCB 130.

Figure 9:
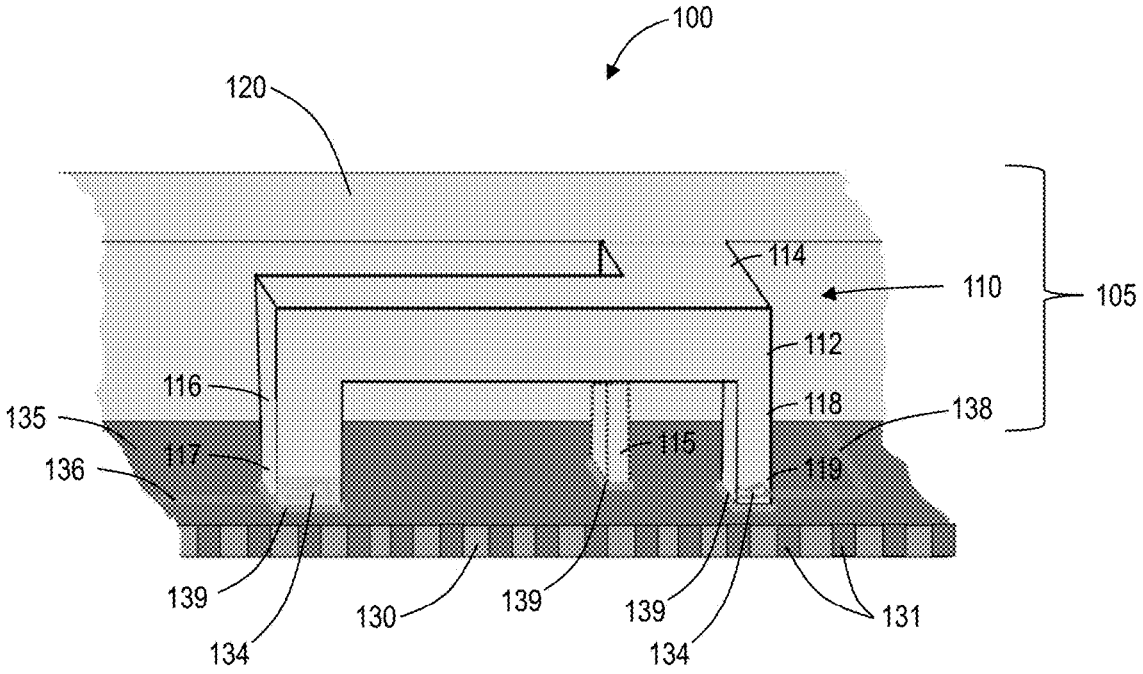
FIG. 9 is a perspective diagram of an embodiment of the integrated antenna system of FIG. 2.
Figure 10:
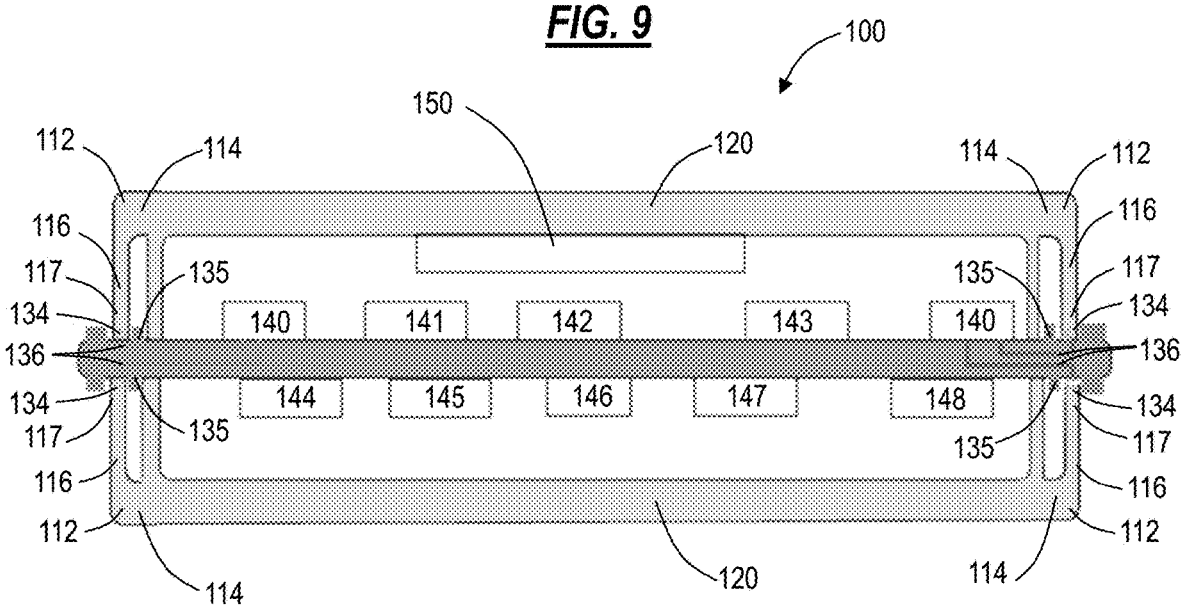
FIG. 10 is a cross-sectional diagram of an embodiment of the integrated antenna system of FIG. 9 including two integrated metallic components.

FIG. 9 is a perspective diagram of an embodiment of the integrated antenna system 100 of FIG. 2. FIG. 10 is a cross-sectional diagram of an embodiment of the integrated antenna system 100 of FIG. 9 including two integrated metallic components 105. In embodiments and as illustrated in FIGS. 9 and 10, an outer layer 135 of the PCB 130, such as a top or bottom layer of the PCB 130, is flooded with a conductive material, such as copper. As can be seen in FIG. 9, the conductive material at the outer layer 135 thermally contacts the metallic body 120, such as at a base thereof. In embodiments, vias 131 positioned around a perimeter of the PCB 130, which are also adapted to have thermal contact with the metallic component 105. The flooded outer layer 135 includes a clearance around each of the antenna legs 115, 116, 118, such as the antenna feed leg 116 and the antenna termination legs 115, 118, such that the conductive material does not contact the contact ends 117, 119 of the antenna legs 115, 116, 118. In these embodiments, the RF traces, such as the RF signal trace 136 and the RF signal return 138 are on middle layers of the PCB 130, separated from the flooded outer surface(s) 135 and the vias 131.

Figure 11:
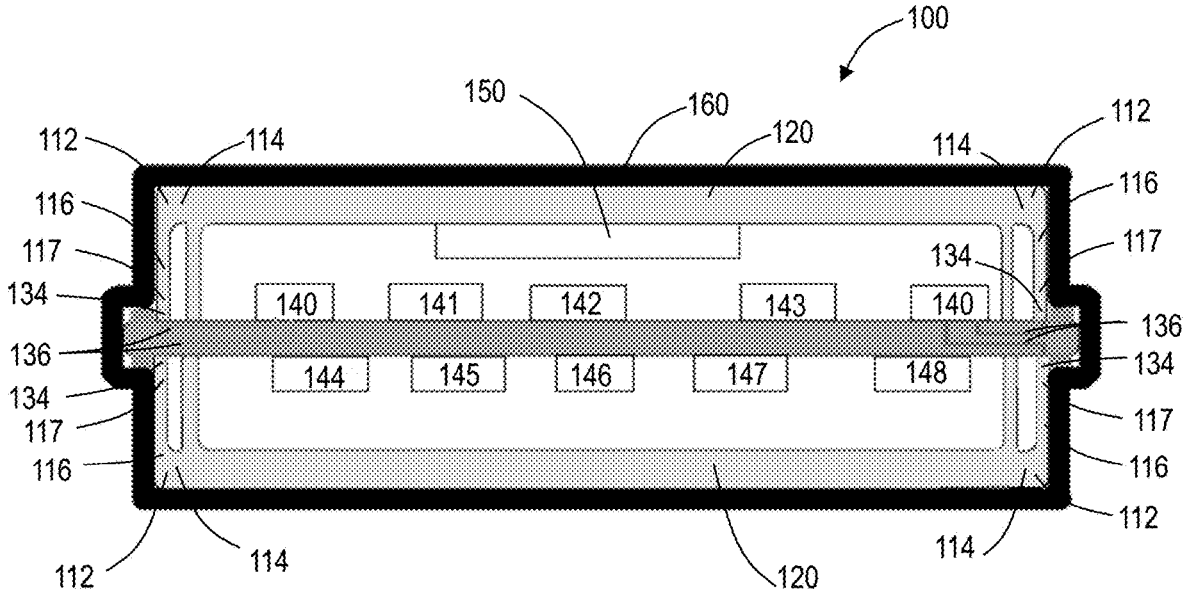
FIG. 11 is a cross-sectional diagram of an embodiment of the integrated antenna system of FIG. 10.

FIG. 11 is a cross-sectional diagram of an embodiment of the integrated antenna system 100 of FIG. 10. In some embodiments, the integrated antenna system 100 further includes a cover 160. The cover 160 surrounds all or at least a portion of the one or more integrated metallic components 105 and the PCB 130. In embodiments, the cover 160 is one of paint, plastic, ceramic, leather, a weather resistant coating, and the like.

Figure 12:
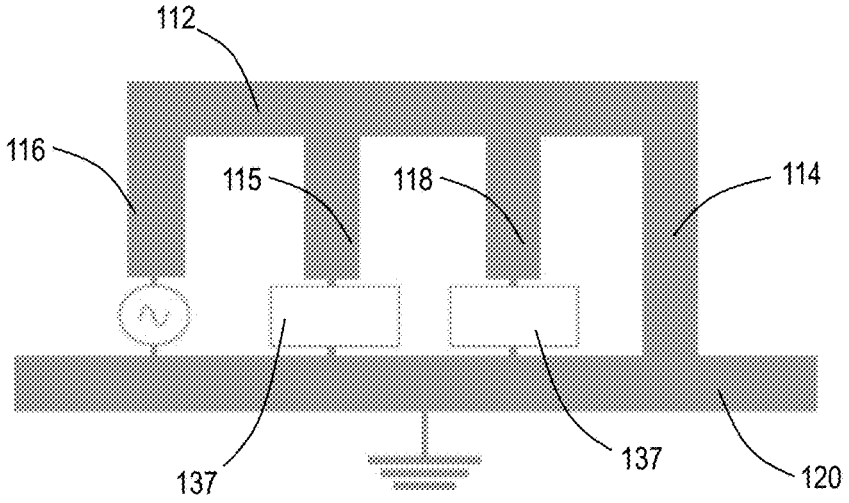
FIG. 12 is a schematic illustration of the integrated antenna system of FIG. 2.

FIG. 12 is a schematic illustration of the integrated antenna system 100 of FIG. 2. As noted above, the antenna element 112 is connected to the metallic body 120 through a ground, short wall 114. The antenna element 112 is fed through an antenna feed leg 116 and can be terminated by an antenna termination leg 118. Based on antenna element matching and mechanical support requirements, further antenna termination legs 115 can also be included. The matching network 137 for each termination leg 115, 118 can include a combination of inductors (L) and capacitors (C), or be left open.

Figure 13:
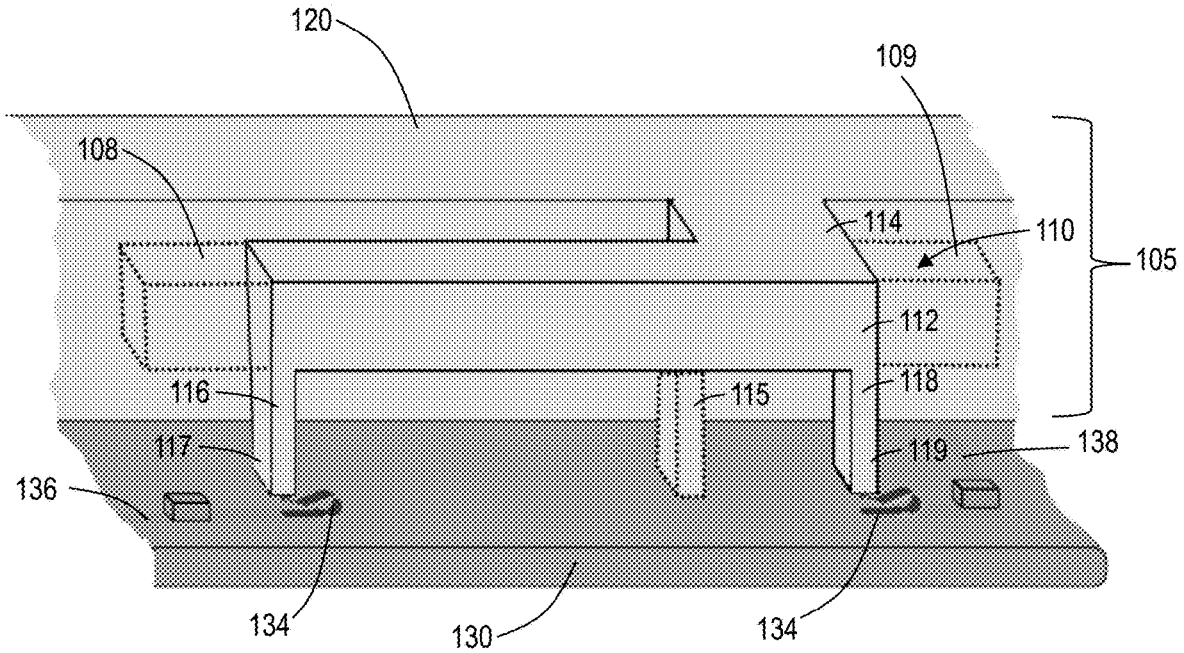
FIG. 13 is a perspective diagram of an embodiment of the integrated antenna system of FIG. 2.

FIG. 13 is a perspective diagram of an embodiment of the integrated antenna system of FIG. 2. In embodiments, additional extensions 108, 109 beyond the length described above, between the antenna feed leg 116 and the short wall 114, and the antenna feed leg 116 and the antenna termination leg 118, are added. The extension 108 extending beyond the antenna feed leg 116 relative to the short wall 114 and the extension 109 extends beyond the short wall 114 relative to the antenna feed leg 116. Due to the relative width and thickness of the antenna element 112, the additional extensions 108, 109 provide expand the antenna element 112 to a multi-band element, which can expand to cover bands for 2 GHz Wi-Fi, 5 GHz Wi-Fi, and UWB. In embodiments, the additional extensions 108, 109 each extends beyond a feed point/termination point, such as the antenna feed leg 116 and the antenna termination leg 118 by less than one-tenth of the wavelength.

Figure 14:
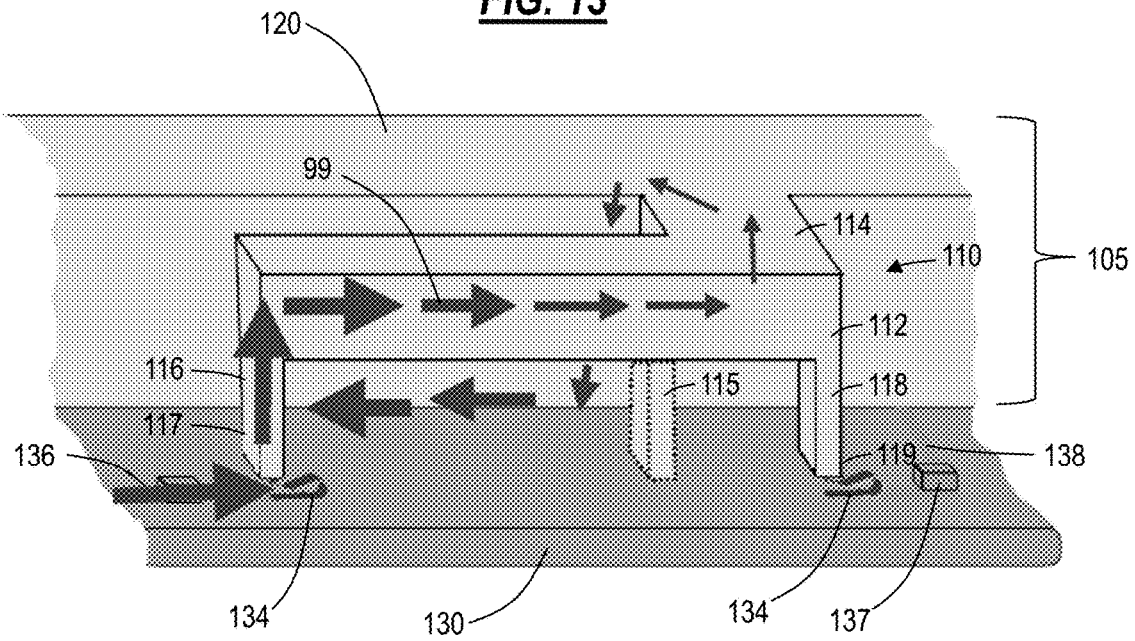
FIG. 14 is a perspective diagram of the integrated antenna system of FIG. 2 illustrating a current flow with an open termination.
Figure 15:
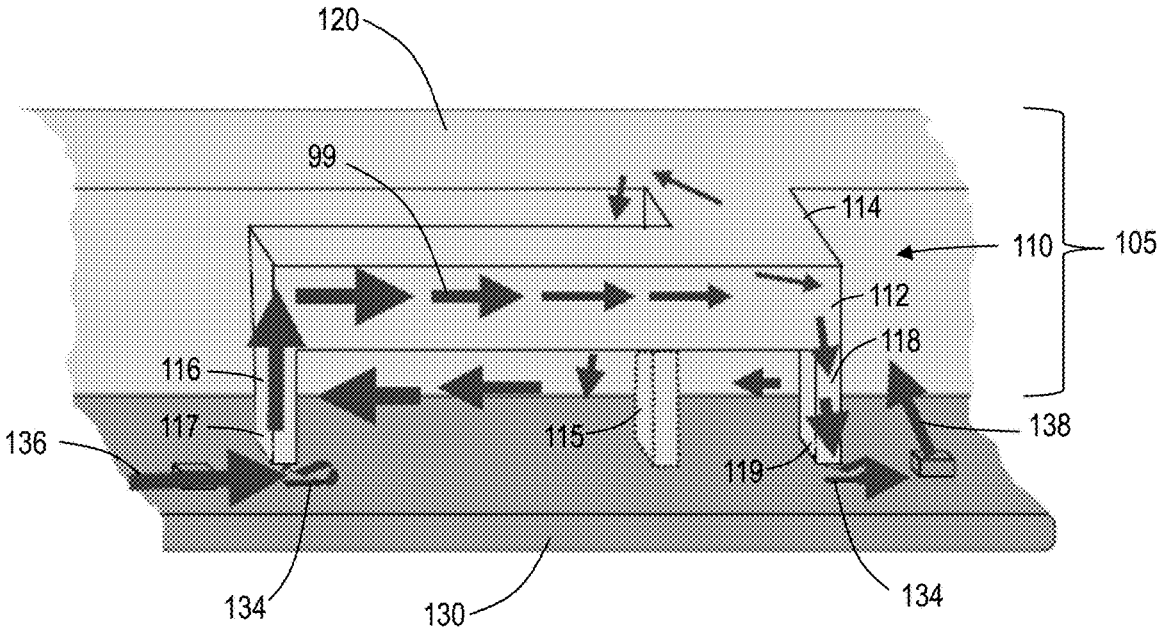
FIG. 15 is a perspective diagram of the integrated antenna system of FIG. 2 illustrating a current flow with an inductor (L) and/or capacitor (C) termination.

FIG. 14 is a perspective diagram of the integrated antenna system 100 of FIG. 2 illustrating a current flow with an open termination. FIG. 15 is a perspective diagram of the integrated antenna system 100 of FIG. 2 illustrating a current flow with an inductor (L) and/or capacitor (C) termination. As can be seen in FIGS. 14 and 15, the current flow in the antenna system 100 can be dependent on the configuration of termination of the antenna, and in particular, the matching network 137. In embodiments where the matching network 137 is left open, as illustrated in FIG. 14, the current forms a loop starting from an antenna feed up the antenna feed leg 116, extending across the length of the antenna element 112, through the short wall 114, and back to the antenna feed. In the embodiments where the matching network 137 terminates the system with an L and/or a C termination, the current loops from the antenna feed and through the short wall and back to the antenna feed (as in the case of the open termination), but also loops from the antenna feed, through the matching network 137, and back to the antenna feed. Due to this control in the current loops, spacing between antennas 110 in an electronic device can be reduced, such as to about one-sixth of a wavelength at 5 GHz, and down to one-twelfth of a wavelength at other frequencies, and still maintain sufficient isolation between antenna elements 112.

Figure 16:
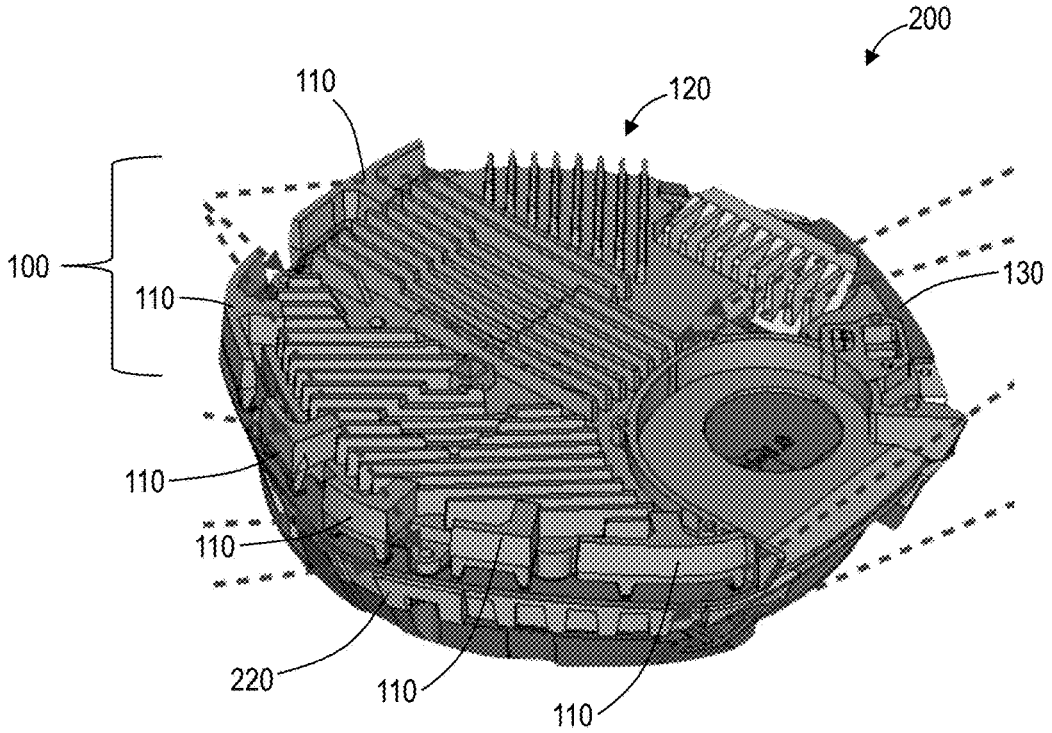
FIG. 16 is a perspective diagram of a portion of a wireless device including an integrated antenna system.
Figure 17:
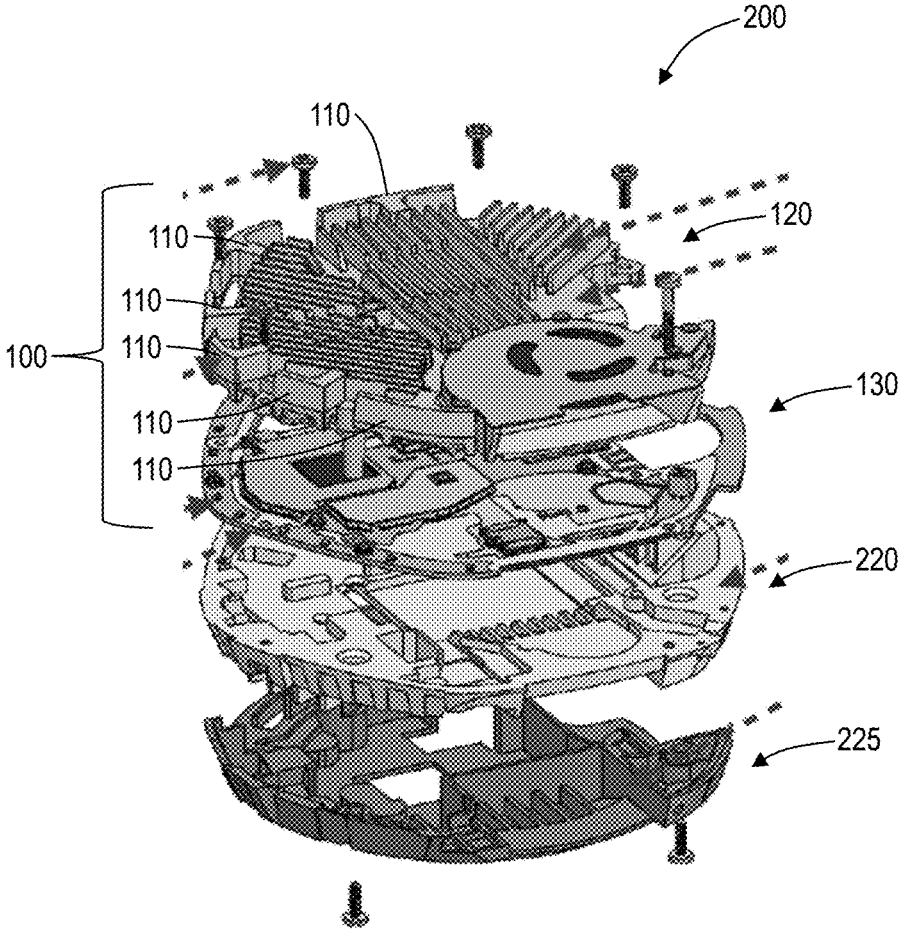
FIG. 17 is an exploded perspective diagram of the portion of the wireless device of FIG. 16.

FIG. 16 is a perspective diagram of a portion of a wireless device 200 including an integrated antenna system 100. FIG. 17 is an exploded perspective diagram of the portion of the wireless device 200 of FIG. 16. Referring to FIGS. 16 and 17, the integrated metallic component 105 includes multiple antennas 110, many of which are minimally spaced, positioned around a perimeter of the metallic body 120. In the embodiment illustrated, the metallic body 120 is a heat sink and includes fins that are oriented to dissipate heat and includes an opening and a chassis like structure for receiving a fan. As can be seen in FIGS. 16 and 17, the overall contour of each of the antennas 110 can generally follow the contour of the perimeter of the metallic body 120 and that of the overall wireless device 200.

In the embodiment illustrated, the wireless device 200 also includes a mid-heatsink 220 and a bottom heatsink 225, each of which can include antennas 110 integrally formed therein.

It will be appreciated that some embodiments described herein may include or utilize one or more generic or specialized processors ("one or more processors") such as microprocessors; Central Processing Units (CPUs); Digital Signal Processors (DSPs): customized processors such as Network Processors (NPs) or Network Processing Units (NPUs), Graphics Processing Units (GPUs), or the like; Field-Programmable Gate Arrays (FPGAs); and the like along with unique stored program instructions (including both software and firmware) for control thereof to implement, in conjunction with certain non-processor circuits, some, most, or all of the functions of the methods and/or systems described herein. Alternatively, some or all functions may be implemented by a state machine that has no stored program instructions, or in one or more Application-Specific Integrated Circuits (ASICs), in which each function or some combinations of certain of the functions are implemented as custom logic or circuitry. Of course, a combination of the aforementioned approaches may be used. For some of the embodiments described herein, a corresponding device in hardware and optionally with software, firmware, and a combination thereof can be referred to as "circuitry configured to," "logic configured to," etc. perform a set of operations, steps, methods, processes, algorithms, functions, techniques, etc. on digital and/or analog signals as described herein for the various embodiments.

Moreover, some embodiments may include a non-transitory computer-readable medium having instructions stored thereon for programming a computer, server, appliance, device, processor, circuit, etc. to perform functions as described and claimed herein. Examples of such non-transitory computer-readable medium include, but are not limited to, a hard disk, an optical storage device, a magnetic storage device, a Read-Only Memory (ROM), a Programmable ROM (PROM), an Erasable PROM (EPROM), an Electrically EPROM (EEPROM), Flash memory, and the like. When stored in the non-transitory computer-readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various embodiments.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. An integrated metallic component, comprising

A metallic body adapted to at least one of act as a heat exchanger and at least partially enclose electronic components on a Printed Circuit Board (PCB); and an antenna including an antenna element offset from the metallic body and including a length extending along a perimeter of the metallic body, a short wall connecting the antenna element to the metallic body, and an antenna feed leg offset from the short wall in a direction of the length of the antenna element and adapted to extend from the antenna element to the PCB and to form an electrical connection with an electrical contact for a Radio Frequency (RF) signal trace on the PCB.

2. The integrated metallic component of claim 1, wherein the metallic body forms a continuous shield around circuitry in a device including the integrated metallic component.

3. The integrated metallic component of claim 1, wherein the metallic body is configured to act as a heat sink.

4. The integrated metallic component of claim 1, wherein the integrated metallic component comprises a plurality of antennas, including the antenna, positioned about the perimeter of the metallic body, each connected thereto by a corresponding short wall.

5. The integrated metallic component of claim 4, wherein each of the plurality of antennas is adapted to operate at a different frequency.

6. The integrated metallic component of claim 4, wherein the plurality of antennas are operating at a same frequency in a Multiple Input Multiple Output (MIMO) configuration.

7. The integrated metallic component of claim 4, wherein adjacent antennas of the plurality of antennas are separated by less than a quarter wavelength of operating frequencies thereof.

8. The integrated metallic component of claim 1, wherein the antenna feed leg forms a cavity in a feed contact end therein, and wherein the cavity is adapted to receive the electrical contact therein with a surface forming the cavity contacting the electrical contact to form the electrical connection while the feed contact end is in contact with the PCB.

9. The integrated metallic component of claim 1, wherein the integrated metallic component is a unitary structure with the metallic body, the antenna element, the short wall, and the antenna feed leg being a single structurally formed unibody.

10. The integrated metallic component of claim 9, wherein the unitary structure is unitarily formed by one of molding, stamping and folding, and machining a single piece of material into the integrated metallic component.

11. The integrated metallic component of claim 1, wherein a length of the antenna element is less than one-fifth of a wavelength that the antenna is adapted to receive, a width of the antenna element is less than one-twentieth of the wavelength, and a thickness of the antenna element is less than one-fifth of the wavelength, wherein a sum of the length, the width and the thickness is less than one-half of the wavelength, and a surface area of the antenna element is more than one-fifth by one-fifth squared wavelengths.

12. The integrated metallic component of claim 1, wherein a portion of the length of the antenna extends beyond the feed point in both directions, and wherein the antenna extends beyond the feed point less than one-tenth of the wavelength in each direction.

13. The integrated metallic component of claim 1, wherein the antenna further includes at least one antenna termination leg offset from the antenna feed leg in a direction of the length of the antenna element and adapted to extend from the antenna element to the PCB and to form an electrical connection with an electrical contact for an RF signal return on the PCB.

14. The integrated metallic component of claim 1, wherein the antenna further includes at least one antenna termination leg offset from the antenna feed leg in a direction of the length of the antenna element, wherein a portion of the length of the antenna extends beyond the termination leg in both directions.

15. An integrated antenna system, comprising:

a Printed Circuit Board (PCB) including a Radio Frequency (RF) signal trace and electronic components; and an integrated metallic component including a metallic body at least one of adapted to act as a heat exchanger and at least partially enclosing the electronic components, and an antenna including an antenna element offset from the metallic body and including a length extending along a perimeter of the metallic body, a short wall connecting the antenna element to the metallic body, and an antenna feed leg offset from the short wall in a direction of the length of the antenna element and extending from the antenna element to the PCB, the antenna feed leg forming an electrical connection with an electrical contact for the RF signal trace.

16. The integrated antenna system of claim 15, wherein the metallic body forms a continuous shield around circuitry in a device including the integrated metallic component.

17. The integrated antenna system of claim 15, wherein the metallic body is configured as a heat sink.

18. The integrated antenna system of claim 15, wherein the integrated metallic component is a unitary structure with the metallic body, the antenna element, the short wall, and the antenna feed leg being a single structurally formed unibody.

19. A wireless device, comprising:

a Printed Circuit Board (PCB) including at least on Radio Frequency (RF) signal trace and electronic components; and at least one integrated metallic component including a metallic body at least one of adapted to act as a heat exchanger and at least partially enclosing the electronic components, and at least one antenna including an antenna element offset from the metallic body and including a length extending along a perimeter of the metallic body, a short wall connecting the antenna element to the metallic body, and an antenna feed leg offset from the short wall in a direction of the length of the antenna element and extending from the antenna element to the PCB, the antenna feed leg forming an electrical connection with an electrical contact for the RF signal trace.

20. The wireless device of claim 19, wherein the metallic body forms a continuous shield around circuitry in a device including the integrated metallic component and acts as a heat sink.

21. The wireless device of claim 19, wherein each of the at least one integrated metallic component is a unitary structure with the metallic body, the antenna element, the short wall, and the antenna feed leg being a single structurally formed unibody.

* * * * *